US010900147B2

(12) United States Patent
Bogan

(10) Patent No.: US 10,900,147 B2
(45) Date of Patent: Jan. 26, 2021

(54) WOVEN TEXTILE WITH POINT-TO-POINT CONDUCTIVE TRACE

(71) Applicant: Microsoft Technology Licensing, LLC, Redmond, WA (US)

(72) Inventor: Kelly Marie Bogan, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 151 days.

(21) Appl. No.: 15/672,093

(22) Filed: Aug. 8, 2017

(65) Prior Publication Data

US 2019/0048494 A1 Feb. 14, 2019

(51) Int. Cl.

| | |
|---|---|
| ***D02G 3/44*** | (2006.01) |
| ***B68G 11/00*** | (2006.01) |
| ***D03D 1/00*** | (2006.01) |
| ***D03D 41/00*** | (2006.01) |
| ***D03D 15/00*** | (2006.01) |
| ***A41D 31/00*** | (2019.01) |
| ***A41D 1/00*** | (2018.01) |
| ***D03D 31/00*** | (2006.01) |
| ***D03D 13/00*** | (2006.01) |

(52) U.S. Cl.

CPC ..... *D02G 3/441* (2013.01); *A41D 1/002* (2013.01); *A41D 31/00* (2013.01); *B68G 11/00* (2013.01); *D03D 1/00* (2013.01); *D03D 1/0017* (2013.01); *D03D 13/00* (2013.01); *D03D 13/002* (2013.01); *D03D 15/00* (2013.01); *D03D 31/00* (2013.01); *D03D 41/00* (2013.01); *A41D 2500/20* (2013.01); *D10B 2401/16* (2013.01); *D10B 2401/18* (2013.01)

(58) Field of Classification Search
None
See application file for complete search history.

(56) References Cited

U.S. PATENT DOCUMENTS

| | | | | |
|---|---|---|---|---|
| 3,636,988 | A * | 1/1972 | Troy | D03D 39/10 139/46 |
| 3,796,234 | A | 3/1974 | Muller | |
| 3,957,088 | A | 5/1976 | Muller et al. | |
| 6,675,837 | B1 | 1/2004 | Russ et al. | |

(Continued)

FOREIGN PATENT DOCUMENTS

| | | | |
|---|---|---|---|
| CA | 2401181 | * | 9/2001 |
| CH | 697245 | * | 7/2008 |

(Continued)

OTHER PUBLICATIONS

Machine translation of CH 697245 (Year: 2008).*

(Continued)

*Primary Examiner* — Shawn Mckinnon
(74) *Attorney, Agent, or Firm* — Holzer Patel Drennan

(57) ABSTRACT

Conductive wires or traces woven into a textile article as a warp or weft yarn are limited in directionality and beginning and end points. The presently disclosed woven electronic textiles permit electrical traces to begin and end at specific points within an interior of the textile and for runs of the electrical traces to extend continuously at any desired angle and connecting any number of specific points across a textile surface. Such electrical traces are referred to herein as point-to-point conductive traces.

19 Claims, 7 Drawing Sheets

(56) References Cited

U.S. PATENT DOCUMENTS

| | | | |
|---|---|---|---|
| 7,231,943 | B2 | 6/2007 | Svensson |
| 8,129,294 | B2 | 3/2012 | Khokar |
| 2006/0228970 | A1 | 10/2006 | Orr et al. |
| 2007/0089800 | A1 | 4/2007 | Sharma |
| 2011/0000576 | A1 | 1/2011 | Yokokawa |
| 2011/0253246 | A1 | 10/2011 | Jalilimanesh |

FOREIGN PATENT DOCUMENTS

| | | | |
|---|---|---|---|
| CH | 697245 | B1 | 7/2008 |
| DE | 4035936 | A1 | 6/1991 |
| EP | 1251196 | A1 | 10/2002 |
| EP | 2128318 | A1 | 12/2009 |
| EP | 2206813 | A1 | 7/2010 |

OTHER PUBLICATIONS

Machine translation of CH697245, Wolff (Year: 2008).*
Ghosh, et al., "Training Manual for Jute Industry," Dept. of Jute & Fibre Technology Institute of Jute Technology, Univ. of Calcutta, 2011-2017, Kolkata, West Bengal, 30 pgs.
"International Search Report and Written Opinion Issued in PCT Application No. PCT/US2018/035927", dated Aug. 27, 2018, 13 Pages.

* cited by examiner

WOVEN TEXTILE WITH POINT-TO-POINT CONDUCTIVE TRACE

BACKGROUND

Weaving is a method of textile production in which two distinct sets of yarns (or threads) are interlaced at right angles to form a fabric (or cloth). Longitudinal yarns are referred to herein as warp yarns and lateral yarns are referred to herein as weft yarns (or filling yarns). The fabric may be woven on a loom, a device that holds the warp yarns in place while the weft yarns are woven there through. The way the warp and filling yarns interlace with one other is referred to herein as the weave.

An electronic circuit is composed of individual electronic components connected by conductive wires or traces through which electric current can flow. A combination of electronic components and connecting wires allows simple to complex arithmetic and/or logical operations to be performed.

Conductive wires or traces may be woven into a cloth as a distinct warp or weft yarn, but as the warp is exclusively longitudinal and the weft is exclusively lateral, directionality of the conductive wires woven into the cloth are likewise limited to longitudinal or lateral runs. Further, the total distance of a lateral or longitudinal conductive run within the cloth is limited to an entire width or length of a particular woven piece. As a result, conductive wires or traces woven into a textile article as a warp or weft yarn are limited in directionality and beginning and end points.

SUMMARY

Implementations described and claimed herein provide a woven textile comprising a warp of non-conductive yarn, a weft of non-conductive yarn, and a conductive yarn woven within the warp and the weft. Each of two end points of the non-conductive yarn are within an interior portion of the woven textile.

Implementations described and claimed herein further provide a method of manufacturing a woven textile with a point-to-point conductive trace. The method comprises weaving a weft of non-conductive yarn within a warp of non-conductive yarn and weaving a conductive yarn within the warp. The conductive yarn includes each of two end points within an interior portion of the woven textile.

Implementations described and claimed herein still further provide a textile loom comprising a full-width picking device to weave a weft of non-conductive yarn within a warp of non-conductive yarn, a point-to-point picking device, and an aerial picking device. The aerial picking device selectively passes through the warp to meet the point-to-point picking device and exchanges an end of a conductive yarn.

Other implementations are also described and recited herein. This Summary is provided to introduce a selection of concepts in a simplified form that are further described below in the Detailed Descriptions. This Summary is not intended to identify key features or essential features of the claimed subject matter, nor is it intended to be used to limit the scope of the claimed subject matter.

BRIEF DESCRIPTIONS OF THE DRAWINGS

DETAILED DESCRIPTIONS

The presently disclosed woven electronic textiles and methods of manufacturing thereof permit electrical traces to begin and end at specific points within an interior of the textile and for runs of the electrical traces to extend continuously at any desired angle and connecting any number of specific points across a textile surface. Such electrical traces are referred to herein as point-to-point conductive traces.

Figure 1:
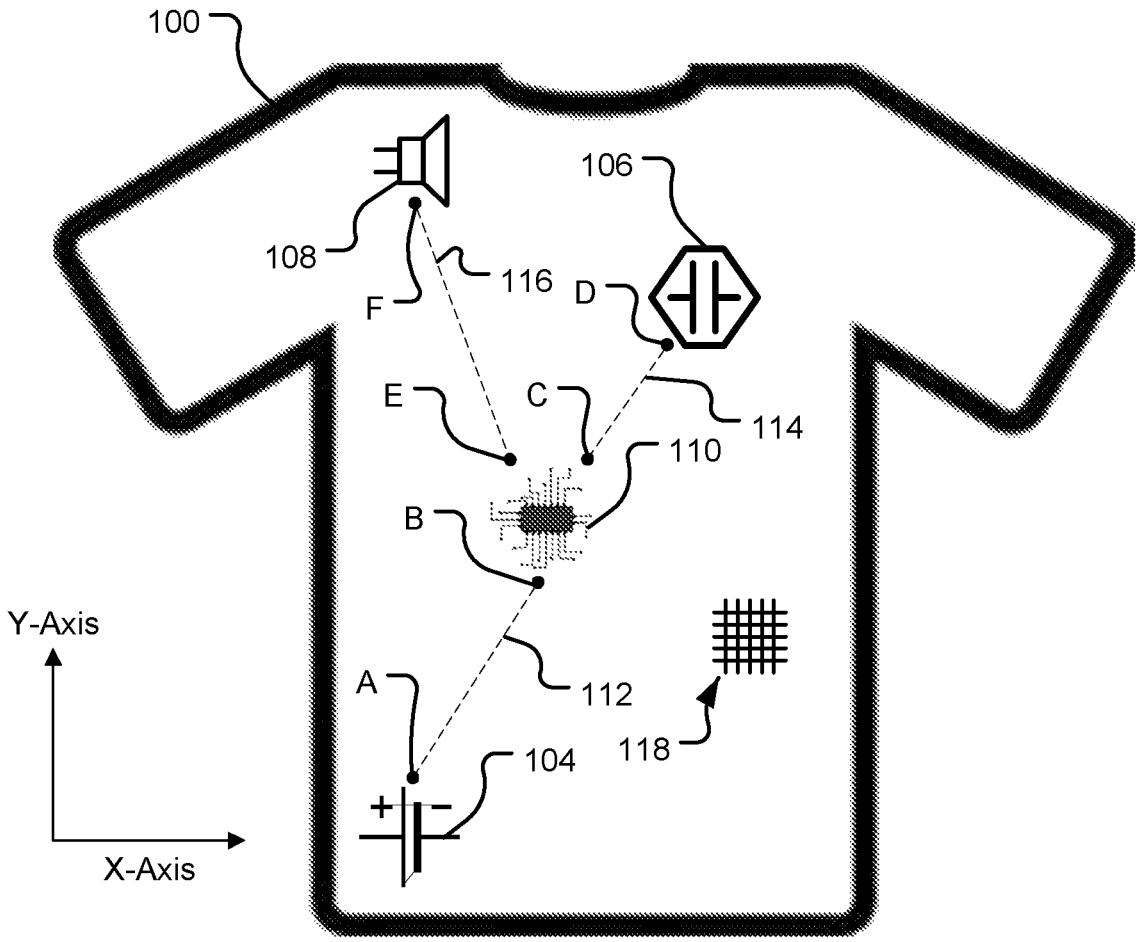
FIG. 1 illustrates a shirt incorporating an example woven electronic textile heart monitor.

FIG. 1 illustrates a shirt 100 incorporating an example woven electronic textile heart monitor. The shirt 100 may be any style or type of shirt made of a woven textile material. The shirt 100 is woven on a loom (not shown, see e.g., loom 330 of FIG. 3), and each distinct panel of fabric that makes up the shirt 100 is woven with distinct warp and weft yarns oriented perpendicularly from one another, as illustrated by grid 118. For example, the weft yarns may extend generally along the x-axis and the warp yarns may extend generally along the y-axis of FIG. 1.

The heart monitor 102 includes a battery 104 for power, a heartbeat sensor 106 oriented near a user's heart when wearing the shirt 100, and an alarm 108 that signals to the user if and when the heartbeat sensor 106 detects an abnormality in the user's heartbeat. All of the battery 104, the heartbeat sensor 106, and the alarm 108 are electrically connected to a microprocessor 110 that controls operation of the heart monitor. In various implementations, the heart monitor may contain greater or fewer individual electronic components than that illustrated in FIG. 1.

The electrical connections between the electronic components 104, 106, 108, 110 are each made by conductive yarns 112, 114, 116 (illustrated by dashed lines as they may be hidden). More specifically, the conductive yarn 112 runs between point A at the battery 104 and point B at the microprocessor 110 and extends at a specific angle involving both x-direction and y-direction components. Similarly, conductive yarn 114 runs between point C at the microprocessor 110 and point D at the heartbeat sensor 106 and also extends at a specific angle (which may be the same or distinct from the angle of the conductive yarn 112) and also involving both x-direction and y-direction components. Further, conductive yarn 116 runs between point E at the microprocessor 110 and point F at the alarm 108 and also extends at a specific angle (which may be the same or distinct from the angle of the conductive yarns 112, 114) and also involving both x-direction and y-direction components.

The conductive yarns 112, 114, 116 are relatively flexible structures that permit weaving within the woven non-conductive textile of the shirt 100 and incorporate material that allows the conductive yarns 112, 114, 116 to be conductive. More specifically, as both metals and semiconductors are relatively stiff materials, the conductive yarns 112, 114, 116 may include a mixture of carbon, metallic, or semiconducting fibers (e.g., carbon, nickel, copper, gold, silver, titanium, and various alloys or compounds thereof) to provide the desired electrical performance, and textile fibers for flexibility, enabling the conductive yarns 112, 114, 116 to be readily woven. In other implementations, the conductive yarns 112, 114, 116 may incorporate fibers containing organic conducting or semi-conducting material, conductive polymers (e.g., polyacetylene, polypyrrole, polyaniline, and their copolymers), and/or conductive molecular solids or salts (e.g., polycyclic aromatic compounds such as pentacene and rubrene).

In an example implementation, the conductive yarns 112, 114, 116 are a complex two-ply twisted yarn or core-covered yarn including a conductive wire and non-conductive textile yarn (e.g., a staple spun, filament, and/or multifilament yarn). These materials may be combined by a twisting or covering process, which imparts strength due to frictional contact points formed between the non-conductive textile fibers. Depending on the selected materials and intended weaving loom type, the yarn may have a specified minimum turns per inch (tpi). The tpi will influence the yarn's tensile strength, which may be within the range of 2-4 MPa.

While FIG. 1 specifically illustrates the shirt 100 incorporating the heat monitor, the woven electronic textiles disclosed herein may be applied to any wearable technology (also known as wearables, fashionable technology, wearable devices, tech togs, and fashion electronics), incorporated into other articles of clothing such as pants, jackets, coats, socks, shoes, gloves, hats, scarfs, and undergarments, and incorporated into upholstery, for example.

For example, the woven electronic textiles disclosed herein may be used to form e-textiles (also known as smart garments, smart clothing, electronic textiles, smart textiles, and smart fabrics), which are fabrics that include digital components (e.g., small computers, microcontrollers, integrated circuits, solar cells, light-emitting diodes, batteries, conductors, resistors, capacitors, transistors, diodes, sensors, actuators, switches, buttons, and other electronics or electronic components) embedded therein. Various e-textiles may illuminate, change color, detect environmental conditions (e.g., sound, vibration, heat, humidity, and pressure), monitor a wearer's body temperature, reduce the wearer's wind resistance during sporting activities, control the wearer's muscle vibration, shield radiation from the wearer, and selectively apply a fluid (e.g., drugs, supplements, moisturizers, and perfumes) on the wearer's skin, for example.

Figure 2:
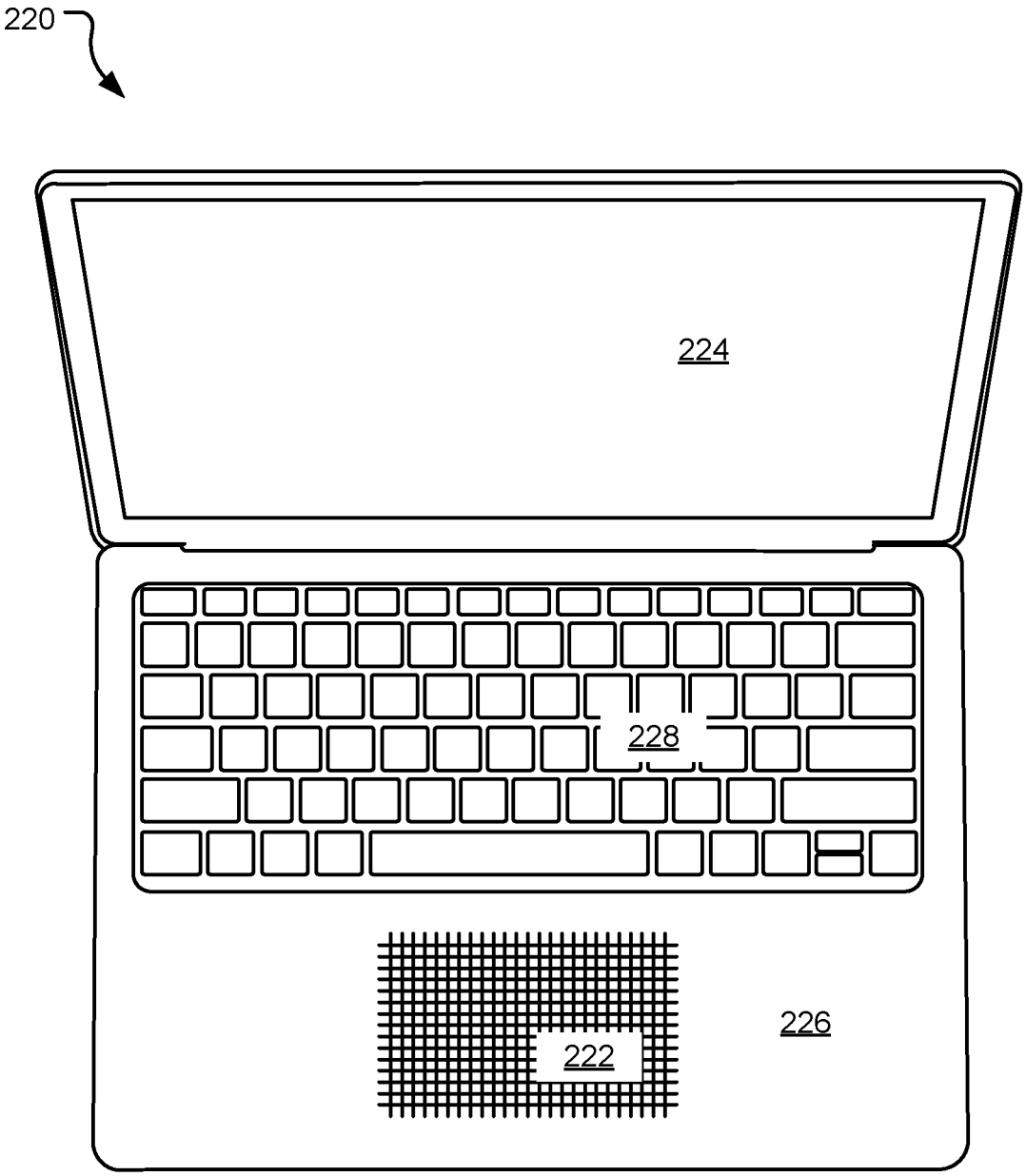
FIG. 2 illustrates a tablet computer incorporating an example electronic fabric trackpad.

FIG. 2 illustrates a tablet computer 220 incorporating an example electronic fabric trackpad 222. The tablet computer 220 includes a display portion 224 hingedly connected to a keyboard portion 226. The display portion 224 may include a touchscreen or other display screen, as well as computing, power, electronic storage, or other electronic components. The keyboard portion 226 may be powered by and/or communicate with the display portion 224 or other aspects of the tablet computer 220 via contacts in connecting hinges (not shown) or communicate wirelessly over a variety of available communication standards (e.g., Bluetooth, infrared, near field communication, ultraband, and ZigBee). In various implementations, the keyboard portion 226 may have its own power supply (e.g., one or more batteries, not shown), be powered from the display portion 224 via the hinges, or be powered wirelessly from the display portion 224 or another power source.

The keyboard portion 226 includes a keypad 228 with an array of keys arranged in a predetermined pattern (e.g., QWERTY) and an electronic fabric trackpad 222 communicatively connected to the tablet computer 220. The electronic fabric trackpad 222 integrates a touch-sensing capability that converts physical user inputs into corresponding electrical signals that may be interpreted by the tablet computer 220. Here, the electronic fabric trackpad 222 is formed by a grid of conductive yarns woven into an electronic fabric covering the keyboard portion 226 of the tablet computer 220. Each of the conductive yarns within the electronic fabric trackpad 222 includes a pair of specific end points within the fabric covering and may extend in directions that are not aligned with warp and weft directions (not shown) of the fabric covering. The conductive yarns of the electronic fabric trackpad 222 may be as described above with regard to conductive yarns 112, 114, 116 of FIG. 1.

The fabric covering may seal the interior of the tablet computer 220 from contaminates and hide seams between the various components of the tablet computer 220. In some implementations, two sheets of woven fabric are oriented on each side of the keyboard portion 226 and are laminated together to form a fabric covering encapsulating the keyboard portion 226. In other implementations, one or more separate sheets of woven fabric are applied (e.g., glued) onto one or more surfaces of the tablet computer 220. The fabric covering may also offer a desirable tactile experience for the user, including but not limited to haptic feedback. As the electronic fabric trackpad 222 is merely an example, the electronic fabric covering may add a variety of other electronic features to the tablet computer 220.

The woven electronic trackpad 222 or other woven electronic textiles disclosed herein may also be incorporated as one or more features of another computing device such as a laptop computer, personal computer, gaming device, smart phone, or any other device that carries out one or more specific sets of arithmetic and/or logical operations.

Figure 3:
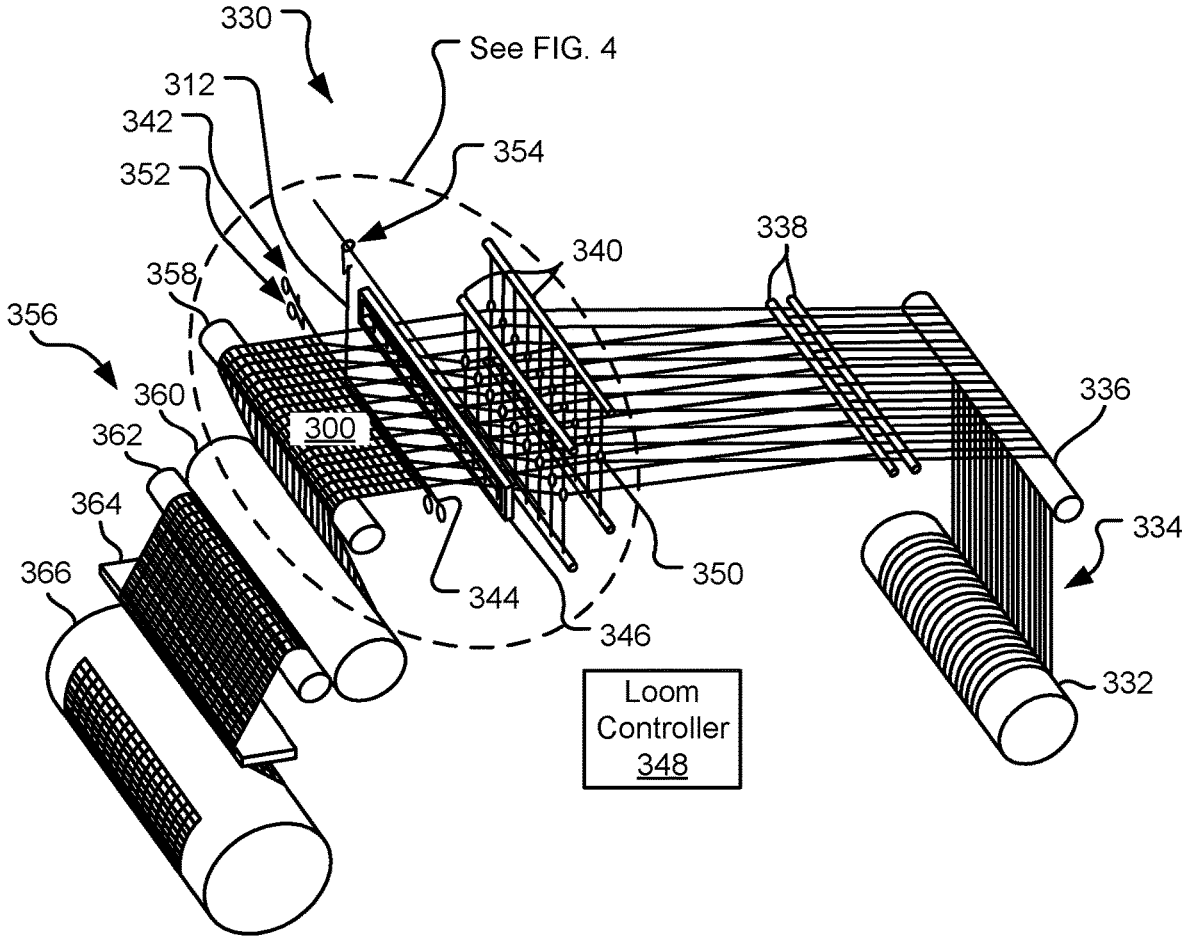
FIG. 3 illustrates an example loom for weaving a textile with a point-to-point conductive trace.

FIG. 3 illustrates an example loom 330 for weaving a textile 300 with a point-to-point conductive trace 312. The loom 330 includes a warp beam 332 around which a series of warps 334 are wound. A motor, gearbox, and/or servo mechanism selectively rotates the warp beam 332 to feed the warps 334 at a desired rate. A tension roller 336 guides and provides a desired amount of tension to the warps 334 and a pair of shed rods 338 divides the warps 334 into predetermined up and down positions. In various implementations, the loom 330 may incorporate crank, tappet (cam), dobby, and/or jacquard shedding mechanisms. A set of heddle frames 340 (or a harness frame) forms openings (shed) by moving the warps 334 up and down. More specifically, each of the heddle frames 340 have the same number of heddles (e.g., heddle 350) through which individual warps 334 are inserted. In other implementations, each of the heddle frames 340 have a different number of heddles depending on a selected woven design and number of warp ends that follow the same movement. A linear motor, gearbox, and/or servo mechanism selectively and separately moves the heddle frames 340 to desired up/down positions. In other implementations that utilize a jacquard shedding mechanism, harness cords control movement of individual warp yarns as distinct from multiple warp yarns through the heddle frames.

A full-width picking device 342 inserts wefts (e.g., weft 344) through the openings formed by the heddle frames 340 an entire width of the textile 300. A point-to-point picking device 352 inserts the conductive trace 312 also through the shed formed by the heddle frames 340. Contrary to the picking device 342, the point-to-point picking device 352 may stop at any point across the width of the textile 300 in order to transfer an end of the conductive trace 312 to an aerial picking device 354. The aerial picking device 354 also may travel and stop at any point across the entire width of the textile 300 in order to vertically align with the point-to-point picking device 352. The aerial picking device 354 and the point-to-point picking device 352 may each hold the conductive trace 312 depending on whether the conductive trace 312 is to extend in the warp-direction or the weft-direction, or a combination thereof, as well as extend on a top-side or under-side of the textile 300.

Figure 4:
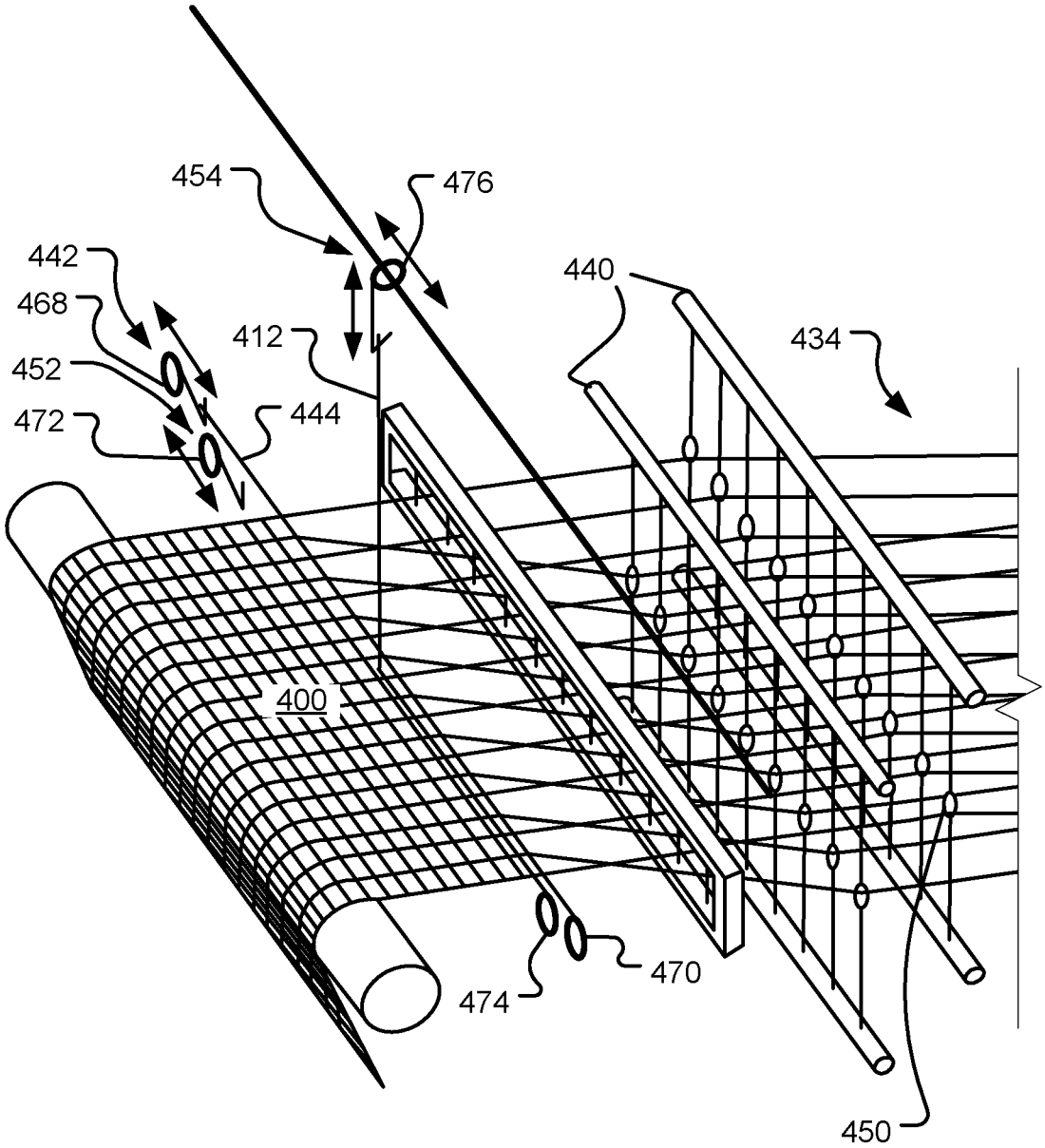
FIG. 4 illustrates a detail view of the example loom of FIG. 3.

In some implementations, some or all of the picking devices 342, 352, 354 may be rapier-type picking devices, as shown in FIGS. 3 and 4 and discussed below in detail with reference to FIG. 4. In other implementations, the picking devices 342, 352, 354 may be shuttle-type picking devices or other types of picking devices.

A reed 346 beats up the wefts at a desired weave density to form the woven textile 300. A linear motor, gearbox, and/or servo mechanism selectively moves the reed 346 to a desired position for each woven weft to define the woven pick density, and then returns to its resting position until the next weft is woven. A take-up device 356 takes up the woven textile 300 formed by the warps 334 and the wefts. In various implementations, the take-up device 356 may include an expansion roller 358, a surface roller 360, a press roller 362, a wrinkle eliminating member 364, and a take-up roller 366, any or all of which may be driven by motors, gearboxes, and/or servo mechanisms.

A loom controller 348 controls operation of the loom 330, including a variety of sensors, motors, gearboxes, and/or servo mechanisms (not shown) and may include computer components, such as a microprocessor, memory, data storage, an output mechanism (e.g., a display and a printer), and an input mechanism (e.g., buttons, a touchscreen, a keyboard, a trackpad, and a mouse).

FIG. 4 illustrates a detail view of the example loom 330 of FIG. 3. A set of heddle frames 440 forms openings (shed) by moving warps 434 up and down. More specifically, each of the heddle frames 440 have the same number of heddles (e.g., heddle 450) through which individual warps 434 are threaded. In other implementations, each of the heddle frames 440 have a different number of heddles depending on a selected woven design and number of warp ends that follow the same movement. A full-width picking device 442 inserts wefts (e.g., weft 444) through the openings formed by the heddle frames 440 an entire width of the textile 400.

In the depicted implementation, the full-width picking device 442 is a rapier-type picking device that includes a rapier head 468 and a rapier wheel 470. The rapier head 468 travels the full-width of textile 400 and meets the rapier wheel 470, which contains (or is connected to) a spool (or package) of non-conductive yarn. The rapier head 468 grabs an end of the non-conductive yarn and retracts to its original position, pulling the non-conductive yarn across and through the openings formed by the heddle frames 440. The non-conductive yarn is cut at or near the rapier wheel 470, thus forming a weft. The full-width picking device 442 repeats this process to form the textile 400 one weft at a time.

A motor, gearbox, and/or servo mechanism selectively rotates the rapier wheel 470 to feed the non-conductive yarn at a desired rate and/or maintain a desired tension in the non-conductive yarn. A linear motor, gearbox, and/or servo mechanism selectively and separately moves the full-width picking device 442 across the textile 400. In other implementations, dual rapier heads meet each other at a middle portion of the textile 400 and transfer the end of the non-conductive yarn. As a result, each of the duel rapier heads only travels half the full-width of the textile 400, but in combination still travel the full width of the textile 400.

In still further implementations, shuttle-type picking devices, air or water jet devices, or other types of picking devices may be used as well.

A point-to-point picking device 452 inserts conductive trace 412 also through the openings formed by the heddle frames 440. Contrary to the picking device 442, the point-to-point picking device 452 may stop at any point across the width of the textile 400 in order to transfer an end of the conductive trace 412 to an aerial picking device 454. The aerial picking device 454 also may travel and stop at any point across the entire width of the textile 400 in order to vertically align with the point-to-point picking device 452. The aerial picking device 454 and the point-to-point picking device 452 may each hold the conductive trace 412 depending on whether the conductive trace 412 is to extend in the warp-direction or the weft-direction, or a combination thereof, as well as extend on a top-side or under-side of the textile 400.

In the depicted implementation, the point-to-point picking device 452 is a rapier-type picking device that includes a rapier head 472 and a rapier wheel 474. The rapier head 472 first travels the full-width of the textile 400 and meets the rapier wheel 474, which contains (or is connected to) a spool of conductive yarn. The rapier head 472 grabs an end of the conductive yarn and retracts to a specific position within the width of the textile 400 marking an end point for the conductive trace 412 within the textile 400.

The aerial picking device 454 is also depicted as a rapier-type picking device that includes a rapier head 476. The aerial picking device 454 moves laterally across the width of the textile 400 to align vertically with the end point for the conductive trace 412 and the current position of the rapier head 472. The rapier head 476 extends vertically through the textile 400 to meet the rapier head 472. The end of the conductive trace 412 is transferred from the rapier head 472 to the rapier head 476. The rapier head 472 returns to its original position without the conductive trace 412 and the rapier head 476 returns to its original position with the conductive trace 412 attached, thereby drawing the conductive trace 412 vertically through the textile 400.

Prior to a next hand-off of the conductive trace 412 from the rapier head 476 to the rapier head 472, the aerial picking device 454 may hold the end of the conductive trace 412 above the textile 400 while one or more additional wefts are added to the textile 400 with the full-width picking device 442. Meanwhile, the point-to-point picking device 452 and the aerial picking device 454 remain parked. In implementations where the conductive trace 412 runs in the same direction as the weft, one or more additional hand-offs of the conductive trace 412 are performed without adding wefts to the textile 400.

After any desired additional wefts are added to the textile 400, the aerial picking device 454 moves laterally to another specific position within the width of the textile 400 and the rapier head 476 extends vertically through the textile 400 carrying the conductive trace 412 through the textile 400. The rapier head 472 moves laterally across the textile 400 to meet the rapier head 476 and transfer the end of the conductive trace 412 back to the rapier head 472. The rapier head 476 returns to its original position without the conductive trace 412 and the rapier head 472 moves to another specific position within the width of the textile 400. The point-to-point picking device 452 and the aerial picking device 454 iteratively repeats this hand-off process, with the full-width picking device 442 also placing wefts to weave the conductive trace 412 into the textile 400.

In some implementations, the spool of conductive yarn is located on (or attached to) the rapier wheel 474 and the conductive trace 412 is drawn through the textile 400 as it is woven into the textile 400. In other implementations, the spool of conductive yarn is passed between the point-to-point picking device 452 and the aerial picking device 454 at each hand-off process. In still further implementations, two spools of conductive yarn are included, one located on (or attached to) the rapier wheel 474 and another passed between the point-to-point picking device 452 and the aerial picking device 454. Once the conductive trace 412 is woven into the textile 400 and has definite start and end points, the conductive yarn is cut from the spool(s) of conductive yarn.

A motor, gearbox, and/or servo mechanism selectively rotates the spool(s) of conductive yarn to feed the conductive yarn at a desired rate and/or maintain a desired tension in the conductive yarn. Linear motors, gearbox, and/or servo mechanisms selectively and separately move the point-to-point picking device 452 and the aerial picking device 454 with respect to the textile 400.

Figure 5:
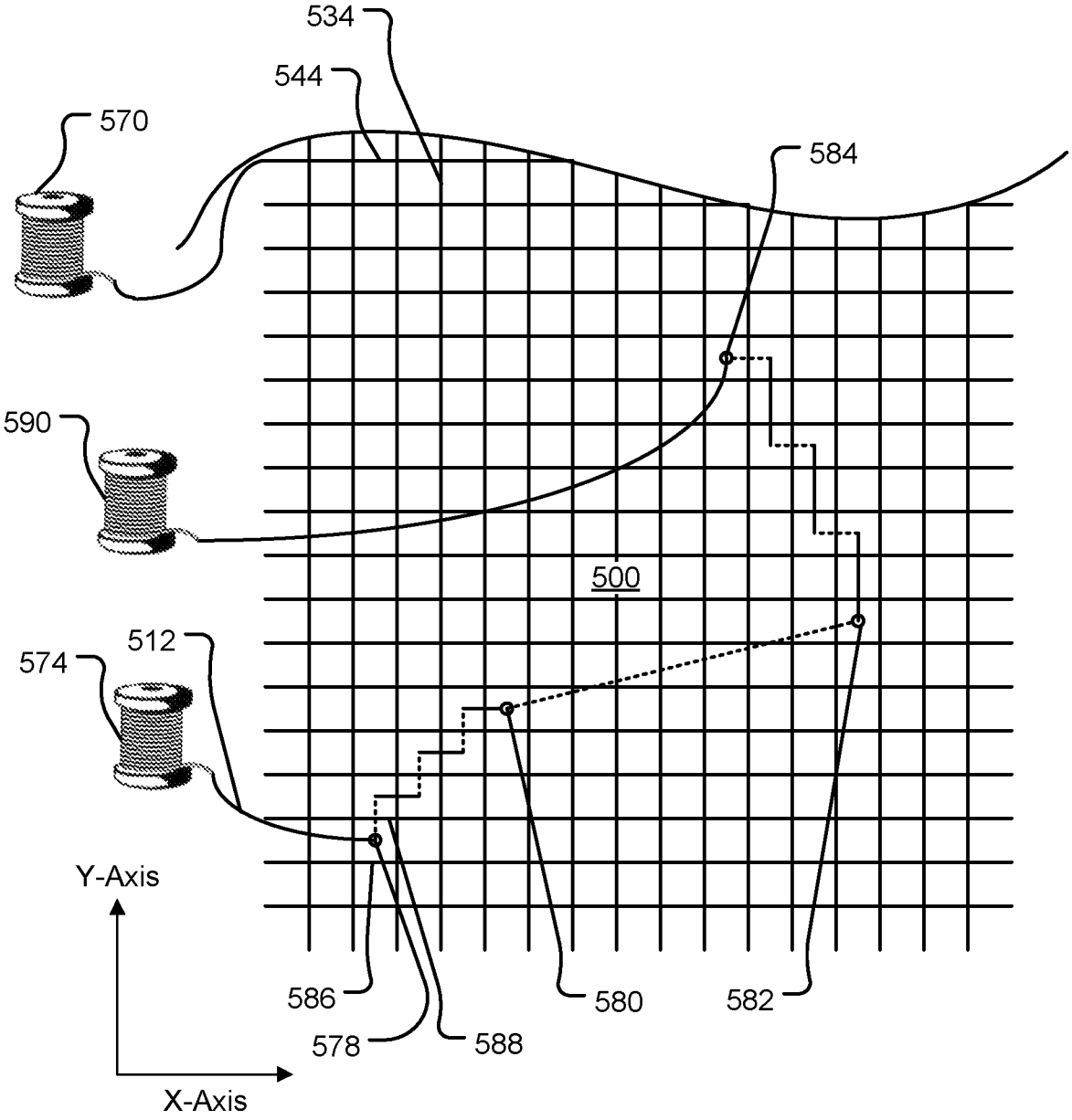
FIG. 5 illustrates an example textile with a point-to-point conductive trace woven therein.

FIG. 5 illustrates an example textile 500 with a point-to-point conductive trace 512 woven therein. The textile 500 is generally formed from a woven grid of non-conductive warp yarns (e.g., yarn 534) extending generally in the y-direction and non-conductive weft yarns (e.g., yarn 544) extending generally in the x-direction. While the textile 500 shows a simple woven grid for simplicity purposes, the textile 500 may incorporate any type of woven structure using the warp and the weft (e.g., plain, twill, satin, pile, layered, tubular, 3D, and custom complex weaves).

The ends of the non-conductive weft yarns are generally cut as each weft is added to the textile 500, as shown. Weft yarn 544 is shown still connected to a spool of non-conductive yarn 570, as it has not yet been cut. Once weft yarn 544 has been cut, another weft yarn may be added to the textile 500 and then cut. This process repeats and the textile 500 is constructed extending in the y-direction until a desired length of the textile 500 has been achieved. At that point, the warp yarns are cut and the textile 500 has a final outer perimeter on all four sides.

The conductive trace 512 is initially inserted into the textile 500 at a desired end point 578 as the textile 500 is woven, specifically following weft 586, but prior to weaving weft 588. The conductive trace 512 is woven into the textile 500 in the y-direction by passing the conductive trace 512 through the textile 500 following each of the three next wefts, and also by traversing across the next three warps within textile 500 in the x-direction in a stair step pattern. The conductive trace 512 is illustrated in solid lines where the conductive trace 512 extends across a top-side of the textile 500 and in dotted lines where the conductive trace 512 extends across a bottom-side of the textile 500. The end result is that the conductive trace 512 is woven continuously from the desired end point 578 to a desired intermediate point 580.

The conductive trace 512 passes through textile 500 at intermediate point 580, under the textile 500 and across two additional wefts and eight warps, and back through the textile 500 at intermediate point 582. The path traced by the conductive trace 512 between intermediate points 580, 582 does not pass over and under the warps and wefts therebetween. This is distinct from the path traced by the conductive trace 512 between the end point 578 and the intermediate point 580, which is woven between the warps and wefts between the end point 578 and the intermediate point 580.

The conductive trace 512 continues from the intermediate point 582 in the y-direction by passing the conductive trace 512 through the textile 500 following the second, fourth, and sixth of the next six wefts, and also by traversing across three warps within textile 500 in the negative x-direction in a stair step pattern. The conductive trace 512 is illustrated in solid lines where the conductive trace 512 extends across a top-side of the textile 500 and in dotted lines where the conductive trace 512 extends across a bottom-side of the textile 500. The end result is that the conductive trace 512 is woven continuously from the intermediate point 582 to a desired end point 584.

One or both of the ends of the conductive trace 512 are connected to spools 574, 590 that feed the conductive yarn as it is woven into the textile 500 and forms the conductive trace 512. In an implementation where the spool 574 contains the conductive yarn, the conductive trace 512 is pulled through the textile 500 and concurrently unwound as it is woven into the textile 500 to feed the conductive yarn. In an implementation where the spool 590 contains the conductive yarn, the spool 590 is passed through the textile 500 as the conductive trace 512 is woven into the textile 500 and concurrently unwound. In implementations that include both the spools 574, 590, the aforementioned mechanisms for feeding the conductive yarn are combined.

All of the end points 578, 584 and the intermediate points 580, 582 are within an inner portion of the textile 500 distinct from the perimeter of the textile 500 and the conductive trace 512 extends between the end points 578, 584 and the intermediate points 580, 582 in directions distinct from the warp direction (y-direction) and the weft direction (x-direction). Further, the end points 578, 584 and the intermediate points 580, 582 do not form a straight line (or are non-collinear). In various implementations, the end points 578, 584 and the intermediate points 580, 582 may serve as connection points for electronic devices that are later attached to the textile 500 (see e.g., shirt 100 of FIG. 1 and tablet computer 220 of FIG. 2, described in detail above). Further, the textile 500 may be manufactured using a variety of types of looms (e.g., loom 330 of FIG. 3, described in detail above).

Figure 6:
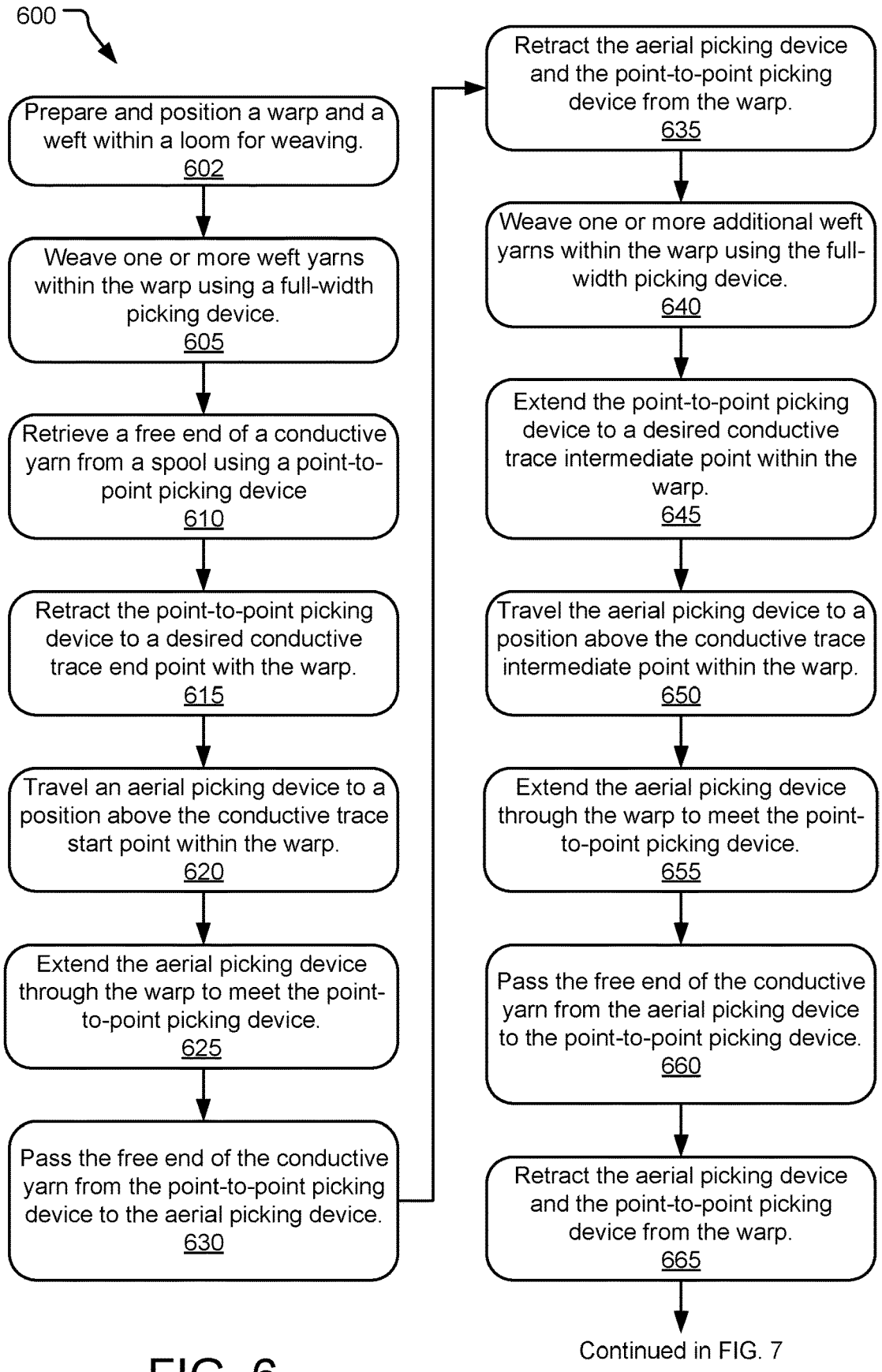
FIG. 6 illustrates example operations for weaving an electronic textile with a point-to-point conductive trace.

FIG. 6 illustrates example operations 600 for weaving an electronic textile with one or more point-to-point conductive traces. A preparing operation 602 prepares and positions a non-conductive warp and a non-conductive weft within a loom for weaving. More specifically, the preparing operation 602 may include one or more of warp winding, warping (or beaming), sizing and/or slashing, looming, drawing-in, and tying-in. Once the preparing operation 602 is complete, the loom is prepared to weave the weft yarns into the warp yarns.

A first non-conductive weaving operation 605 weaves one or more weft yarns within the warp using a full-width picking device. In various implementations, the full-width picking device may be a rapier-type, a shuttle-type, or another type of picking device. Once the woven textile reaches a point within the warp that is intended for starting a conductive trace, a retrieving operation 610 retrieves a free end of a conductive yarn from a spool of the conductive yarn using a point-to-point picking device. The point-to-point picking device may also be a rapier-type, shuttle-type, or another type of picking device. In a rapier-type point-to-point picking device implementation with a spool of conductive yarn attached to the rapier wheel, a rapier extends from a parked position on one side of the loom to the opposite side of the loom to meet the rapier wheel. The rapier grabs the free end of the conductive yarn from the rapier wheel.

A first retracting operation 615 retracts the point-to-point picking device to a desired conductive trace end point within the warp, thereby placing the point-to-point picking device at the desired conductive trace end point. The rapier retracts from the rapier wheel to a point within the textile width where the conductive trace is to begin and pulls the free end of the conductive trace with it. A first traveling operation 620 travels an aerial picking device to a position above the conductive trace start point within the warp. The aerial picking device may also be a rapier-type, shuttle-type, or another type of picking device mounted on a trolley or other device that permits the aerial picking device to travel across the width of the textile.

A first extending operation 625 extends the aerial picking device through the warp to meet the point-to-point picking device. In a rapier-type aerial picking device implementation, a rapier extends from the aerial picking device through the warp to meet the point-to-point rapier. A first passing operation 630 (also referred to herein as an exchange or hand-off) passes the free end of the conductive yarn from the point-to-point picking device to the aerial picking device.

A second retracting operation 635 retracts the aerial picking device and the point-to-point picking device from the warp. The aerial rapier may return to its original position or another position above the textile, pulling the free end of the conductive yarn through the warp with it. The point-to-point rapier may also return to its original resting position without the conductive yarn attached.

A second non-conductive weaving operation 640 weaves one or more additional non-conductive weft yarns within the warp using the full-width picking device. A second extending operation 645 extends the point-to-point picking device to a desired conductive trace intermediate point within the warp. The conductive trace intermediate point may be merely to weave the conductive trace between one or more warp and/or weft yarns, or to create an intermediate contact point for a later attached electronic component.

A second traveling operation 650 travels the aerial picking device to a position above the conductive trace intermediate point within the warp. A third extending operation 655 extends the aerial picking device through the warp to meet the point-to-point picking device. A second passing operation 660 passes the free end of the conductive yarn from the aerial picking device to the point-to-point picking device.

A third retracting operation 665 retracts the aerial picking device and the point-to-point picking device from the warp. The aerial rapier may return to its original position or another position above the textile without the conductive yarn attached. The point-to-point rapier may also return to its original resting position, or another position below the textile, pulling the free end of the conductive yarn through the warp with it.

Figure 7:
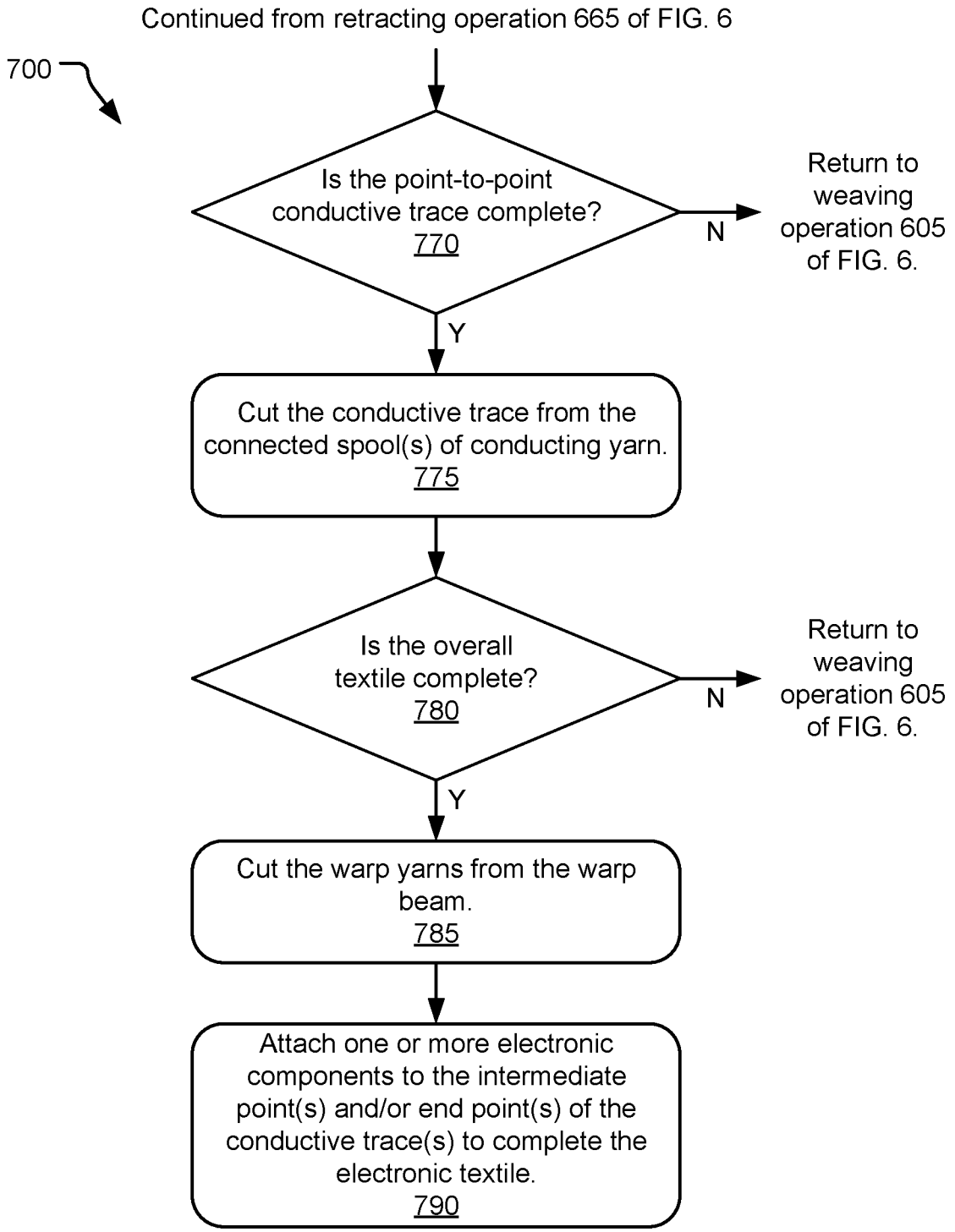
FIG. 7 illustrates additional example operations for weaving an electronic textile with a point-to-point conductive trace.

FIG. 7 illustrates additional example operations 700 for weaving an electronic with a point-to-point conductive trace. Following the third retracting operation 665 of FIG. 6, a first decision operation 770 determines if the point-to-point conductive trace is complete. If not, some or all of the operations 605-665 of FIG. 6 repeat to further weave the conductive trace into the fabric.

Operations 610-665 of FIG. 6 discussed in detail above assume a spool of conductive yarn is attached to the rapier wheel of the point-to-point picking device and that the conductive yarn is drawn from the rapier wheel by the point-to-point picking device and the aerial picking device. In other implementations, the spool of conductive yarn moves with and passes between the point-to-point picking device and the aerial picking device and the operations 610-665 of FIG. 6 are modified accordingly. In still further implementations, two spools of conductive yarn are included, one attached to the rapier wheel of the point-to-point picking device and the other moving with and passing between the point-to-point picking device and the aerial picking device. When the point-to-point conductive trace is complete, cutting operation 775 cuts the conductive trace from the connected spool(s) of conductive yarn to complete the conductive trace.

A second decision operation 780 determines if the overall textile is complete. If not, some or all of the operations 605-665 of FIG. 6 repeat to weave another conductive trace into the fabric and/or complete weaving the non-conductive weft yarns within the non-conductive warp. When the overall textile is complete, cutting operation 785 cuts the warp yarns from the warp beam to complete the fabric. An attaching operation 790 attaches one or more electronic components to the intermediate point(s) and/or end point(s) of the conductive trace(s) to form the electronic textile (see e.g., shirt 100 of FIG. 1 and tablet computer 220 of FIG. 2, described in detail above).

The operations making up the embodiments of the invention described herein are referred to variously as operations, steps, objects, or modules. Furthermore, the operations may be performed in any order, adding or omitting operations as desired, unless explicitly claimed otherwise or a specific order is inherently necessitated by the claim language.

An example woven textile according to the presently disclosed technology includes a warp shed of non-conductive yarn, a weft of non-conductive yarn, and a conductive yarn woven within the warp shed and the weft. The conductive yarn including each of two end points within an interior portion of the woven textile.

In another example woven textile according to the presently disclosed technology, the conductive yarn extends between the two end points in a direction distinct from a warp direction and a weft direction.

In another example woven textile according to the presently disclosed technology, the conductive yarn is continuous between the two end points.

In another example woven textile according to the presently disclosed technology, the woven textile is incorporated as a component of at least one of an article of clothing, upholstery, an e-textile, and a computing device.

In another example woven textile according to the presently disclosed technology, the conductive yarn further includes one or more intermediate points within the interior portion of the woven textile, where the intermediate points and the two end points are non-collinear.

In another example woven textile according to the presently disclosed technology, the conductive yarn passes unwoven and adjacent the woven textile between at least two points of the intermediate points and the end points.

In another example woven textile according to the presently disclosed technology, the conductive yarn is woven within the woven textile between at least two points of the intermediate points and the end points.

An example method of manufacturing a woven textile according to the presently disclosed technology includes weaving a weft of non-conductive yarn within a warp shed of non-conductive yarn and weaving a conductive yarn within the warp shed. The conductive yarn includes each of two end points within an interior portion of the woven textile.

In another example method of manufacturing a woven textile according to the presently disclosed technology, the weaving the weft within the warp shed is performed using a full-width picking device.

In another example method of manufacturing a woven textile according to the presently disclosed technology, the weaving the conductive yarn within the warp shed includes passing an end of the conductive yarn between a point-to-point picking device and an aerial picking device.

In another example method of manufacturing a woven textile according to the presently disclosed technology, the weaving the conductive yarn within the warp shed includes placing a point-to-point picking device to a desired point within the warp shed, extending an aerial picking device through the warp shed to meet the point-to-point picking device prior to passing the end of the conductive yarn between the point-to-point picking device and the aerial picking device, and retracting the aerial picking device from the warp shed.

In another example method of manufacturing a woven textile according to the presently disclosed technology, the weaving the conductive yarn within the warp shed further includes traveling the aerial picking device to a point above the desired point within the warp shed prior to extending the aerial picking device.

In another example method of manufacturing a woven textile according to the presently disclosed technology, the point-to-point picking device initially holds the end of the conductive yarn and passes the end of the conductive yarn to the aerial picking device.

In another example method of manufacturing a woven textile according to the presently disclosed technology, the aerial picking device initially holds the end of the conductive yarn and passes the end of the conductive yarn to the point-to-point picking device.

In another example method of manufacturing a woven textile according to the presently disclosed technology, one or both of two ends of the conductive yarn include a spool of conductive yarn.

Another example method of manufacturing a woven textile according to the presently disclosed technology further includes cutting one or both of two ends of the conductive yarn from a spool of conductive yarn.

An example textile loom according to the presently disclosed technology includes a full-width picking device to weave a weft of non-conductive yarn within a warp shed of non-conductive yarn, a point-to-point picking device, and an aerial picking device. The aerial picking device selectively passes through the warp shed to meet the point-to-point picking device and exchange an end of a conductive yarn.

In another example textile loom according to the presently disclosed technology, the point-to-point picking device and the aerial picking device in conjunction weave the conductive yarn into a textile woven by the full-width picking device.

In another example textile loom according to the presently disclosed technology, the full-width picking device and the point-to-point picking device originate from the same side of the textile loom.

In another example textile loom according to the presently disclosed technology, the point-to-point picking device selectively stops at a desired point within a width of the warp shed of non-conductive yarn and the aerial picking device selectively stops at a point above the point-to-point picking device prior to meeting the point-to-point picking device.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A woven electronic trackpad for a computing device comprising:

a warp shed of comprising a warp non-conductive yarn;

a weft of non-conductive yarn, wherein the warp and the weft cover a portion of the computing device; and a conductive yarn woven within the warp shed and the weft and including each of two intermediate points and two end points within an interior portion of the woven textile, wherein the conductive yarn extends linearly between the two intermediate points in a direction distinct from a warp direction and a weft direction unwoven and adjacent the woven textile across multiple warp and weft threads, each of the two end points of the conductive yarn connected to the computing device, wherein the warp, the weft, and the conductive yarn form a user input for the woven electronic trackpad.

2. The woven textile covering of claim 1, wherein the conductive yarn also extends between one of the two intermediate points and one of the two end points in another direction distinct from the warp direction and the weft direction.

3. The woven textile covering of claim 1, wherein the conductive yarn is continuous between the two end points.

4. The woven textile covering of claim 1, wherein the conductive yarn forms an electrical connection between electronic components of the computing device.

5. The woven textile covering of claim 1, wherein the two intermediate points and the two end points are non-collinear.

6. The woven textile covering of claim 1, wherein the conductive yarn extends in another direction distinct from the warp direction and the weft direction unwoven and adjacent the woven textile across multiple warp threads and multiple weft threads between one of the two intermediate points and one of the two end points.

7. The woven textile covering of claim 1, wherein the conductive yarn is woven within the woven textile in a stair step pattern between one of the two intermediate points and one of the two end points.

8. A method of manufacturing a woven textile with a point-to-point conductive trace comprising:

weaving a weft of non-conductive yarn within a warp shed of non-conductive yarn; and weaving a conductive yarn within the warp shed including passing an end of the conductive yarn between a point-to-point picking device and an aerial picking device of a rapier textile loom, the conductive yarn including each of two intermediate points and two end points within an interior portion of the woven textile, wherein the conductive yarn extends between the two intermediate points in a direction distinct from a warp direction and a weft direction unwoven and adjacent the woven textile across multiple warp and weft threads.

9. The method of claim 8, wherein the weaving the weft within the warp shed is performed using a full-width picking device.

10. The method of claim 8, wherein the weaving the conductive yarn within the warp shed includes:

placing the point-to-point picking device to a desired point within the warp shed;

extending the aerial picking device through the warp shed to meet the point-to-point picking device prior to passing the end of the conductive yarn between the point-to-point picking device and the aerial picking device; and retracting the aerial picking device from the warp shed.

11. The method of claim 10, wherein the weaving the conductive yarn within the warp shed further includes:

traveling the aerial picking device to a point above the desired point within the warp shed prior to extending the aerial picking device.

12. The method of claim 10, wherein the point-to-point picking device initially holds the end of the conductive yarn and passes the end of the conductive yarn to the aerial picking device.

13. The method of claim 10, wherein the aerial picking device initially holds the end of the conductive yarn and passes the end of the conductive yarn to the point-to-point picking device.

14. The method of claim 8, wherein one or both of two ends of the conductive yarn include a spool of conductive yarn.

15. The method of claim 8, further comprising:

cutting one or both of two ends of the conductive yarn from a spool of conductive yarn.

16. A textile loom comprising:

a full-width picking device to weave a weft of non-conductive yarn within a warp shed of non-conductive yarn;

a point-to-point picking device; and an aerial picking device, the aerial picking device to selectively pass through the warp shed to meet the point-to-point picking device and exchange an end of a conductive yarn.

17. The textile loom of claim 16, the point-to-point picking device and the aerial picking device in conjunction to weave the conductive yarn into a textile woven by the full-width picking device.

18. The textile loom of claim 16, wherein the full-width picking device and the point-to-point picking device originate from the same side of the textile loom.

19. The textile loom of claim 16, the point-to-point picking device to selectively stop at a desired point within a width of the warp shed of non-conductive yarn and the aerial picking device to selectively stop at a point above the point-to-point picking device prior to meeting the point-to-point picking device.

* * * * *